US011619384B2

(12) United States Patent
Bozzuto et al.

(10) Patent No.: US 11,619,384 B2
(45) Date of Patent: Apr. 4, 2023

(54) SYSTEM AND METHOD FOR OPERATING A COMBUSTION CHAMBER

(71) Applicant: GENERAL ELECTRIC TECHNOLOGY GMBH, Baden (CH)

(72) Inventors: Carl Bozzuto, Enfield, CT (US); Carl Neuschaefer, Enfield, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 649 days.

(21) Appl. No.: 15/495,243

(22) Filed: Apr. 24, 2017

(65) Prior Publication Data

US 2018/0306441 A1 Oct. 25, 2018

(51) Int. Cl.
*F23N 1/00* (2006.01)
*F23N 5/08* (2006.01)
(Continued)

(52) U.S. Cl.
CPC ..... *F23N 1/002* (2013.01); *F23C 5/12* (2013.01); *F23C 5/32* (2013.01); *F23C 6/047* (2013.01); *F23N 5/082* (2013.01); *F23N 2229/04* (2020.01); *F23N 2229/20* (2020.01); *F23N 2237/02* (2020.01); *F23N 2237/04* (2020.01); *F23N 2237/10* (2020.01); *F23N 2900/05001* (2013.01)

(58) Field of Classification Search
CPC .... F23C 5/12; F23C 5/32; F23C 6/047; F23N 1/002; F23N 5/082; F23N 2229/04; F23N 2229/20; F23N 2237/02; F23N 2237/04; F23N 2237/10; F23N 2900/05001
USPC ..... 431/12
See application file for complete search history.

(56) References Cited

U.S. PATENT DOCUMENTS 4,043,742 A * 8/1977 Egan ..... F23N 1/022 431/12
5,480,298 A * 1/1996 Brown ..... F01D 21/003 431/79

(Continued)

FOREIGN PATENT DOCUMENTS

WO 97/45677 A1 12/1997

OTHER PUBLICATIONS

International Search Report and Written Opinion issued in connection with corresponding PCT Application No. PCT/EP2018/060253 dated Jul. 23, 2018.

(Continued)

*Primary Examiner* — Steven B McAllister
*Assistant Examiner* — Benjamin W Johnson
(74) *Attorney, Agent, or Firm* — Grogan, Tuccillo & Vanderleeden, LLP

(57) ABSTRACT

A method for operating a combustion chamber is provided. The method includes introducing a fuel into the combustion chamber via a plurality of nozzles, each nozzle having an associated stoichiometry for an output end of the nozzle. The method further includes measuring the stoichiometry of each nozzle via one or more sensors to obtain stoichiometric data, and determining that at least one of a frequency and an amplitude of spectral line fluctuations derived from the stoichiometric data has exceeded a threshold. The method further includes adjusting the stoichiometry of at least one of the nozzles based at least in part on the stoichiometric data so as to maintain a flame stability of the combustion chamber.

11 Claims, 5 Drawing Sheets

(51) Int. Cl.

| | |
|---|---|
| ***F23C 6/04*** | (2006.01) |
| ***F23C 5/08*** | (2006.01) |
| ***F23C 5/32*** | (2006.01) |

(56) References Cited

U.S. PATENT DOCUMENTS

| | | | | |
|---|---|---|---|---|
| 5,599,179 | A | 2/1997 | Lindner et al. | |
| 8,926,317 | B2 * | 1/2015 | Farrell | F23N 5/18 431/4 |
| 2002/0081545 | A1 * | 6/2002 | Mindermann | F23N 5/082 431/18 |
| 2004/0191914 | A1 | 9/2004 | Widmer et al. | |
| 2005/0247066 | A1 * | 11/2005 | Myhre | F01D 17/02 60/803 |
| 2009/0308331 | A1 * | 12/2009 | D'Agostini | F23L 7/007 122/13.01 |
| 2010/0151397 | A1 | 6/2010 | Farrell et al. | |
| 2011/0045422 | A1 | 2/2011 | Tanca | |
| 2012/0052450 | A1 | 3/2012 | Lou et al. | |
| 2012/0145052 | A1 | 6/2012 | Levasseur et al. | |
| 2013/0302738 | A1 * | 11/2013 | Rennie | F23N 1/022 431/12 |
| 2016/0209031 | A1 * | 7/2016 | Lou | F23N 5/242 |

OTHER PUBLICATIONS

Republic of Korea Notice of Allowance dated Oct. 20, 2022 from corresponding Republic of Korea Application No. 10-2019-7033225.

* cited by examiner

SYSTEM AND METHOD FOR OPERATING A COMBUSTION CHAMBER

BACKGROUND

Technical Field

Embodiments of the invention relate generally to energy production, and more specifically, to a system and method for operating a combustion chamber.

DISCUSSION OF ART

Electrical power grids, also referred to hereinafter simply as "power grids," are systems for delivering electrical energy generated by one or more power plants to end consumers, e.g., business, households, etc. The minimum electrical power drawn/demanded from a power grid by consumers during a given time period, e.g., a day, is known as the "baseline demand" of the power grid. The highest amount of electrical power drawn/demanded from a power grid by consumers is known as the "peak demand" of the power grid, and the time period over which peak demand occurs is typically referred to as the "peak hours" of the power grid. Similarly, the time period outside the peak hours of a power grid is usually referred to as the "off-peak hours" of the power gird. The amount and/or rate of fuel combusted within a fossil fuel based power plant, which usually correlates to the amount of electrical power requested by a power grid connected to the fossil fuel based power plant, is known as the "load" on the fossil fuel based power plant and/or its combustion chamber.

Traditionally, many power grids used only fossil fuel based power plants to satisfy baseline demand. As demand for renewable energy sources continues to grow, however, many power grids now receive significant amounts of electricity from renewable energy sources, e.g., solar, wind, etc. The amount of electricity provided by many renewable energy sources, however, often fluctuates during the course of a day and/or a year. For example, wind based power plants typically contribute more electricity to a power grid at night than during the day. Conversely, solar based power plants typically contribute more electricity to a power grid during the day than at night. While recent developments have made it possible for many renewable energy sources to satisfy the baseline power demand of a power grid during off peak hours, e.g., at night, many power grids still rely on fossil fuel based power plants to satisfy peak demand and/or other periods of increased demand unable to be satisfied by renewable energy sources alone.

Generally, the cost of operating a fossil fuel based power plant positively correlates with the size of the load required to satisfy the demand of a connected power grid, e.g., the higher the demand from the power grid, the more fossil fuel consumed to generate the load to satisfy the demand. Many power grids, however, do not consume the entire load generated by a fossil fuel plant when renewable energy sources are able to meet the baseline demand of the power grid during off peak hours. Shutting down a fossil fuel based power plant, i.e., ceasing all combustion operations, is usually problematic given the relatively short cycles between peak and off peak hours. Accordingly, many fossil fuel based power plants will run/operate at lower/reduced loads when one or more renewable energy sources are able to meet the baseline demand of a power grid, while running/operating at higher loads when the renewable energy sources are unable to satisfy the baseline demand. Due to flame stability issues within the combustion chambers of traditional fossil fuel based power plants, however, such traditional fossil fuel based power plants are able to only reduce their loads down to fifty percent ("50%") of their maximum operating load, i.e., the highest load that a fossil fuel based power plant, and/or encompassed combustion chamber, is designed to support/generate. Many power grids presently receive sufficient electricity from renewable sources during off peak hours such that even the 50% reduced loads of many traditional fossil fuel based power plants are not fully consumed. Moreover, because many renewable energy sources are subsidized by various governments, the price of electricity supplied by an encompassing power gird, i.e., the "grid price," is typically too low to be profitable for many traditional fossil fuel based power plants during 50% reduced load operations. Thus, many traditional fossil fuel based power plants suffer environmental and/or economic inefficiency due to their generation of excess load during off peak hours.

What is needed, therefore, is an improved system and method for operating a combustion chamber.

BRIEF DESCRIPTION

In an embodiment, a method for operating a combustion chamber is provided. The method includes introducing a fuel into the combustion chamber via a plurality of nozzles, each nozzle having an associated stoichiometry for an output end of the nozzle. The method further includes measuring the stoichiometry of each nozzle via one or more sensors to obtain stoichiometric data, and determining that at least one of a frequency and an amplitude of spectral line fluctuations derived from the stoichiometric data has exceeded a threshold. The method further includes adjusting the stoichiometry of at least one of the nozzles based at least in part on the stoichiometric data so as to maintain a flame stability of the combustion chamber.

In another embodiment, a system for operating a combustion chamber is provided. The system includes a plurality of nozzles operative to introduce a fuel into the combustion chamber, one or more sensors operative to obtain stoichiometric data via measuring a stoichiometry associated with an output end of at least one of the nozzles, and a controller in electronic communication with the nozzles and the one or more sensors. The controller is operative to determine that at least one of a frequency and an amplitude of spectral line fluctuations derived from the stoichiometric data has exceeded a threshold, and to adjust the stoichiometry of at least one of the nozzles based at least in part on the stoichiometric data so as to maintain a flame stability of the combustion chamber.

In yet another embodiment, a non-transitory computer readable medium storing instructions is provided. The stored instructions are configured to adapt a controller to introduce a fuel into a combustion chamber via a plurality of nozzles, and to measure a stoichiometry associated with an output end of at least one of the nozzles via one or more sensors to obtain stoichiometric data. The stored instructions are further configured to adapt the controller to determine that at least one of a frequency and an amplitude of spectral line fluctuations derived from the stoichiometric data has exceeded a threshold, and adjust the stoichiometry of at least one of the nozzles based at least in part on the obtained stoichiometric data so as to maintain a flame stability of the combustion chamber.

DRAWINGS

The present invention will be better understood from reading the following description of non-limiting embodiments, with reference to the attached drawings, wherein below:

DETAILED DESCRIPTION

Figure 1:
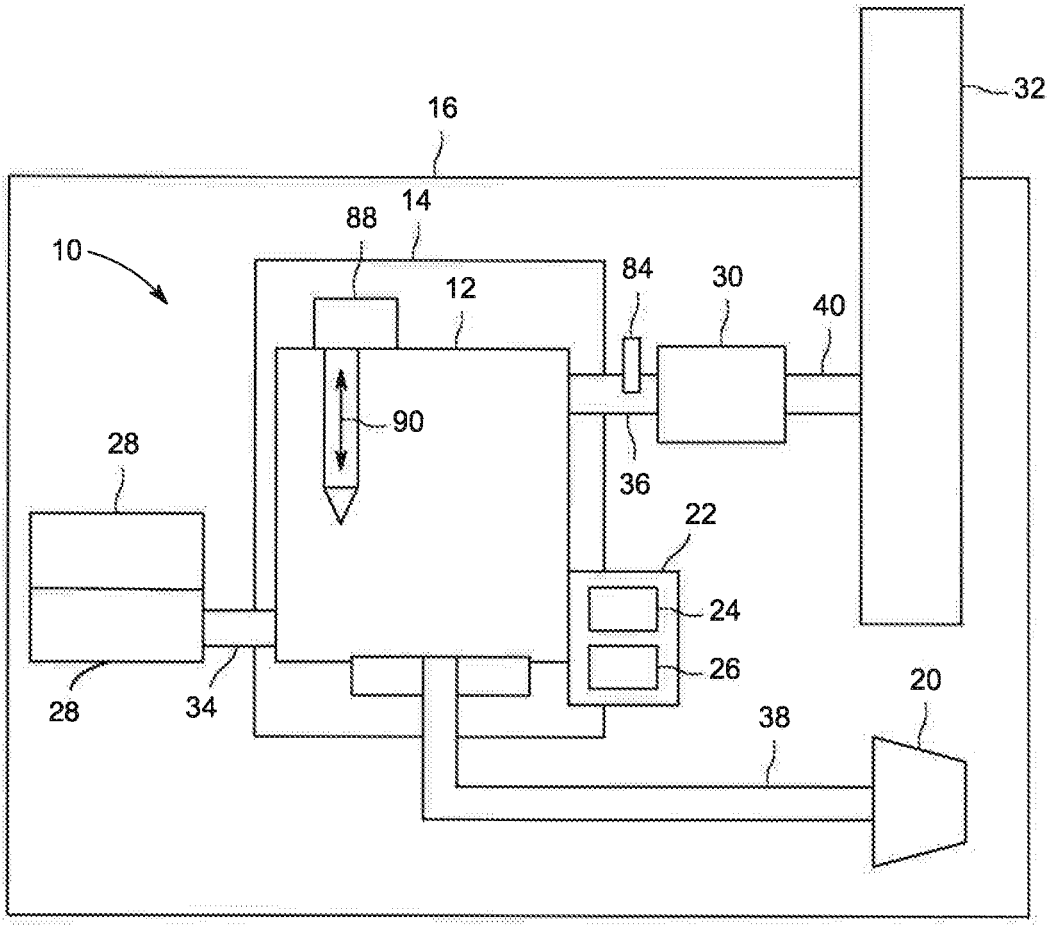
FIG. 1 is a block diagram of a system for operating a combustion chamber, in accordance with an embodiment of the invention.

Reference will be made below in detail to exemplary embodiments of the invention, examples of which are illustrated in the accompanying drawings. Wherever possible, the same reference characters used throughout the drawings refer to the same or like parts, without duplicative description.

As used herein, the terms "substantially," "generally," and "about" indicate conditions within reasonably achievable manufacturing and assembly tolerances, relative to ideal desired conditions suitable for achieving the functional purpose of a component or assembly. The term "real-time," as used herein, means a level of processing responsiveness that a user senses as sufficiently immediate or that enables the processor to keep up with an external process. As used herein, "electrically coupled," "electrically connected," and "electrical communication" mean that the referenced elements are directly or indirectly connected such that an electrical current, or other communication medium, may flow from one to the other. The connection may include a direct conductive connection, i.e., without an intervening capacitive, inductive or active element, an inductive connection, a capacitive connection, and/or any other suitable electrical connection. Intervening components may be present. As also used herein, the term "fluidly connected" means that the referenced elements are connected such that a fluid (to include a liquid, gas, and/or plasma) may flow from one to the other. Accordingly, the terms "upstream" and "downstream," as used herein, describe the position of the referenced elements with respect to a flow path of a fluid and/or gas flowing between and/or near the referenced elements. Further, the term "stream," as used herein with respect to particles, means a continuous or near continuous flow of particles. As also used herein, the term "heating contact" means that the referenced objects are in proximity of one another such that heat/thermal energy can transfer between them. As further used herein, the terms "suspended state combustion," "combusting in a suspended state," and "combusted in a suspended state" refer to the process of combusting a fuel suspended in air. As used herein with respect to a combustion chamber, the term "flame stability" refers to the likelihood that a fireball within the combustion chamber will combust in a predictable manner. Accordingly, when the flame stability of a combustion chamber is high, the fireball will combust in a more predictable manner than the when the flame stability of the combustion chamber is low.

Additionally, while the embodiments disclosed herein are primarily described with respect to a tangentially fired coal based power plant having a combustion chamber that forms part of a boiler, it is to be understood that embodiments of the invention may be applicable to any apparatus and/or methods that need to limit and/or lower the combustion rate of a fuel without ceasing combustion of the fuel all together, e.g., a furnace.

Referring now to FIG. 1, a system 10 for operating a combustion chamber 12 in accordance with embodiments of the invention is shown. As will be understood, in embodiments, the combustion chamber 12 may form part of a boiler 14, which in turn may form part of a power plant 16 that combusts a fuel 18 (FIG. 2), e.g., a fossil fuel such as coal, oil, and/or gas, to produce steam for the generation of electricity via a steam turbine generator 20. The system 10 may further include a controller 22 having at least one processor 24 and a memory device 26, one or more mills 28, a selective catalytic reducer ("SCR") 30, and/or an exhaust stack 32.

As will be understood, the one or more mills 28 are operative to receive and process the fuel 18 for combustion within the combustion chamber 12, i.e., the mills 28 shred, pulverize, and/or otherwise condition the fuel 18 for firing within the combustion chamber 12. For example, in embodiments, the one or more mills 28 may be pulverizer mills, which as used herein refers to a type of mill which crushes/pulverizes solid fuel between grinding rollers and a rotating bowl. The processed fuel 18 is then transported/fed from the mills 28 to the combustion chamber 12 via conduit 34.

The combustion chamber 12 is operative to receive and to facilitate combustion of the fuel 18, which results in the generation of heat and a flue gas. The flue gas may be sent from the combustion chamber 12 to the SCR 30 via conduit 36. In embodiments where the combustion chamber 12 is integrated into a boiler 14, the heat from combusting the fuel 18 may be captured and used to generate steam, e.g., via water walls in heating contact with the flue gas, which is then sent to the steam turbine generator 20 via conduit 38.

The SCR 30 is operative to reduce nitrogen oxides ("NOx") within the flue gas prior to emission of the flue gas into the atmosphere via conduit 40 and exhaust stack 32.

Figure 2:
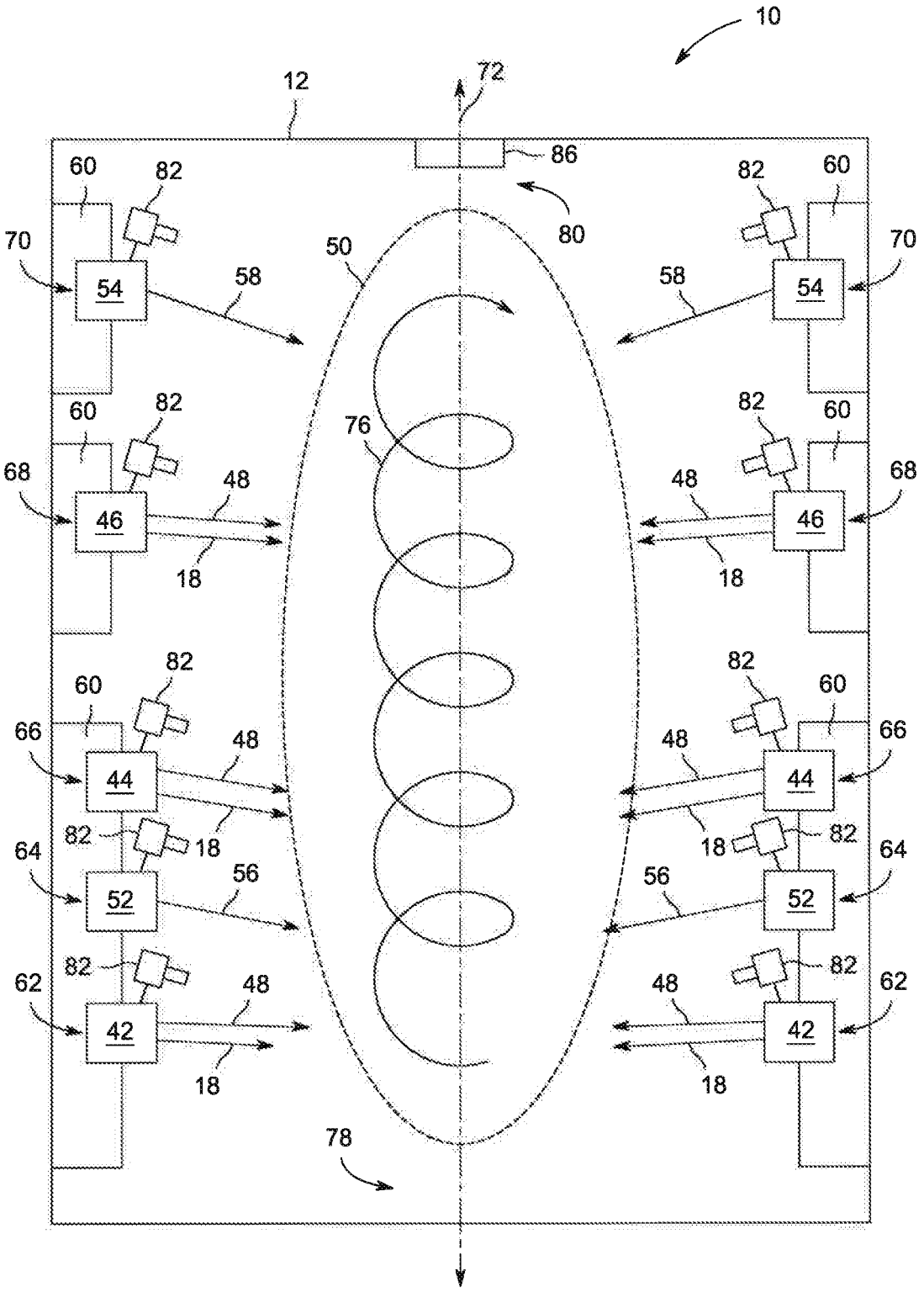
FIG. 2 is a diagram of a combustion chamber of the system of FIG. 1, in accordance with an embodiment of the invention.

Turning now to FIG. 2, the internals of the combustion chamber 12 are shown. The system 10 further includes a plurality of nozzles 42, 44, and/or 46 which are operative to introduce the fuel 18 into the combustion chamber 12 via primary air streams 48, which may be performed in accordance with a reduced load. In other words, the nozzles 42, 44, and/or 46 introduce the fuel 18 and the primary air 48 into the combustion chamber 12 at rates corresponding to a load that is less than half of the maximum operating load of the combustion chamber 12. As will be understood, the fuel 18 and primary air streams 48 are ignited/combusted after exiting an outlet end of the nozzles 42, 44, and 46 so as to form a fireball 50. The system 10 may include additional nozzles 52 and/or 54 through which secondary air 56 and over-fired air 58 may be introduced into the combustion chamber 12 to control/govern the combustion of the fuel 18 within the fireball 50.

In embodiments, the nozzles 42, 44, 46, 52, and/or 54 may be disposed in one or more windboxes 60 and/or arranged into one or more firing layers 62, 64, 66, 68, and 70, i.e., groups of nozzles 42, 44, 46, 52, 54 disposed at and/or near the same position along a vertical/longitudinal axis 72 of the combustion chamber 12. For example, a first firing layer 62 may include nozzles 42 that introduce the fuel 18 and primary air 48, a second firing layer 64 that include nozzles 52 that introduce secondary air 56, a third 66 and/or a fourth 68 firing layers that include nozzles 44 and 46 that introduce the fuel 18 and primary air 48, and a fifth firing layer 70 that includes nozzles 54 that introduce overfired air 58. While the firing layers 62, 64, 66, 68, and 70 are depicted herein as being uniform, i.e., each firing layer 62, 64, 66, 68, and 70 includes either nozzles 42, 44, 46 that introduce only primary air 48 and the fuel 18, nozzles 52 that introduce only secondary air 56, or nozzles 54 that introduce only overfired air 58, it will be understood that, in embodiments, an individual firing layer 62, 64, 66, 68, and 70 may include any combination of nozzles 42, 44, 46, 52, and/or 54. Further, while FIG. 2 shows five (5) firing layers 62, 64, 66, 68, and 70, it will be understood that embodiments of the invention may include any number of firing layers. Further still, nozzles 52 and/or 54 may be disposed next to and/or directed at nozzles 42, 44, and/or 46 such that the secondary 56 and/or overfired 58 air directly supplements the primary air 48 at each nozzle 42, 44, and/or 46.

Figure 3:
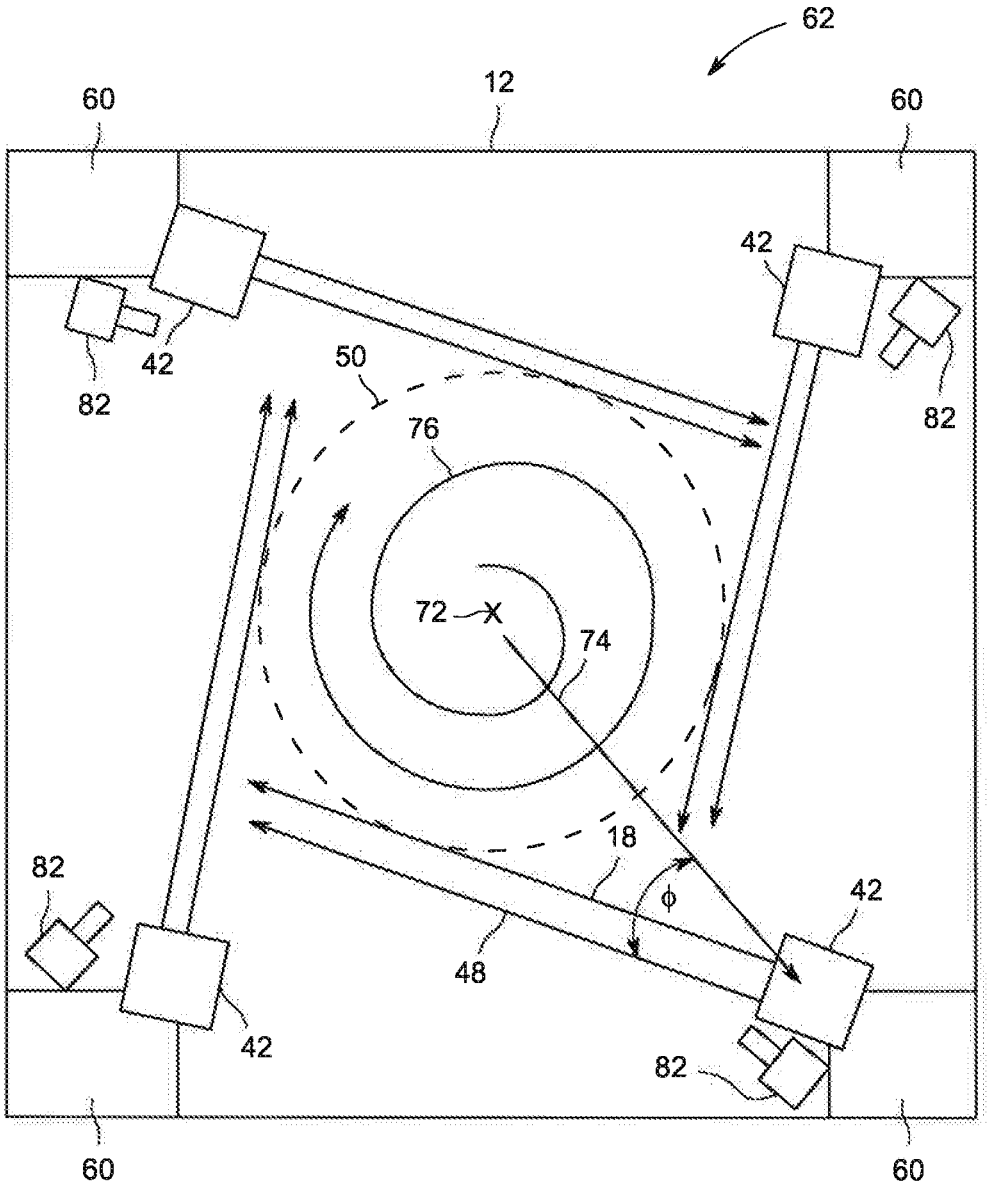
FIG. 3 is a cross-sectional view of a firing layer of the combustion chamber of FIG. 2, in accordance with an embodiment of the invention.

Moving now to FIG. 3, a cross-sectional view of firing layer 62 is shown. As will be appreciated, in embodiments, the fuel 18 may be tangentially fired, i.e., the fuel 18 is introduced into the combustion chamber via nozzles 42 at an angle Ø formed between the trajectory of the primary air stream 48, and a radial line 74 extending from the vertical axis 72 to the nozzles 42. In other words, the nozzles 42 inject the fuel 18 via the primary air stream 48 tangentially to an imaginary circle 50, representative of the fireball, that is centered on the vertical axis 72. In certain aspects, the angle Ø may range from 2-10 degrees. While FIG. 3 depicts the nozzles 42 within the first firing layer 62 as disposed within the corners of the combustion chamber 12, in other embodiments, the nozzles 42 may be disposed at any point within the firing layer 62 outside of the fireball 50. As will be understood, the nozzles 44, 46, 52, and/or 54 (FIG. 2) of the other firing layers 64, 66, 68, and/or 70 (FIG. 2) may be oriented in the same manner as the nozzles 42 of first firing layer 62 shown in FIG. 3.

Returning back to FIG. 2, upon leaving the nozzles 42, 44, and/or 46, the combusting particles of the fuel 12 follow a helix shaped flight path 76, e.g., a corkscrew, within the fireball 50 as they flow in a direction moving from an upstream side 78 of the combustion chamber 12 to a downstream side 80 of the combustion chamber 12. In other words, tangentially firing the fuel 18 causes the fireball 50 to spiral about the vertical axis 72.

As will be understood, in embodiments, the combustion chamber 12 is operated at a normal load, i.e., 60-100% of its maximum load, during periods when renewable energy sources connected to the same power grid as the power plant 16 are unable to meet baseline demand. When the renewable energy sources connected to the power gird are able to meet baseline demand, the controller 22 may operate the combustion chamber 12 at a reduced load, e.g., less than 50% of its maximum load, by reducing the amount of fuel 18, primary air 48, secondary air 56, and/or overfired air 58 introduced into the combustion chamber 12. As will be appreciated, however, a minimal amount of air provided by the primary air 48, secondary air 56, and/or overfired air 58 must be maintained in order to facilitate movement of the fuel 18 through the combustion chamber 12. Thus, in embodiments, the aforementioned minimal amount of air may be a lower constraint on the ability of the controller 22 to reduce the load of the combustion chamber 12. For example, in embodiments, the primary air 48 may be supplied to each nozzle 42, 44, and/or 46 at between about 1-1.5 lbs/lb of fuel, and the controller 22 may adjust the secondary 56 and/or overfired 58 such that the total amount of air available at each nozzle 42, 44, and/or 46 for combustion of the fuel 18 is about 10.0 lbs/lb of fuel.

As stated above, operating the combustion chamber 12 at a reduced load risks lowering the flame stability of the combustion chamber 12, i.e., there is an increased risk that the fireball 50 may begin to combust in a more unpredictable manner. In particular, the flame stability of the combustion chamber 12 is based at least in part on the stoichiometry of one or more of the nozzles 42, 44, and/or 46. As used herein, the stoichiometry of a nozzle 42, 44, and/or 46 refers to the chemical reaction ratios of the primary air 48 and the fuel 18, and in some embodiments, the ratio of the secondary air 56 and/or overfired air 58 consumed by combustion of the fuel 18 at the nozzles 42, 44, and/or 46. As will be appreciated, reduction of the fuel 18, primary air 48, secondary air 56, and/or overfired air 58 by the controller 22 in order to reduce the load on the combustion chamber 12 in turn changes the stoichiometry of one or more of the nozzles 42, 44, and/or 46.

Accordingly, and as also shown in FIG. 2, the system 10 further includes one or more sensors 82 in electronic communication with the controller 22 and operative to obtain stoichiometric data, i.e., data related to the stoichiometry of the products and reactants of the combustion reaction at the nozzles 42, 44, and/or 46, via measuring/monitoring the stoichiometry of at least one of the nozzles 42, 44, 46 that introduces the primary air 48 and the fuel 18, which may be performed in real-time.

For example, in embodiments, spectral lines may be generated/derived from the stoichiometric data. As will be understood, the intensities of the spectral lines may correspond to a stoichiometric amount of a product and/or reactant of the combustion reaction for a nozzle 42, 44, 46. In other words, the spectral lines provide an indication of the stoichiometry of each of the nozzles 42, 44, 46. As will be further understood, the intensities of the spectral lines may fluctuate over time as a result of furnace rumble, which may be between about twenty (20) to about two-hundred (200) cycles per second, thereby producing a waveform that has an amplitude and frequency.

As will be appreciated, changes in the frequency and/or amplitude of the spectral line fluctuations may provide an indication that the flame stability of the combustion chamber 12 is, and/or is trending towards becoming, unstable. Thus, in embodiments, the stoichiometry of one or more of the nozzles 42, 44, 46 may be adjusted if the frequency and/or amplitude of the spectral line fluctuations exceeds a threshold. For example, a change in the frequency and/or amplitude of the spectral line fluctuations of between about 20% to about 25% from baseline frequency and/or amplitude, i.e., the frequency and/or amplitude of the spectral line fluctuations under normal load operations, may indicate that the flame stability of the combustion chamber 12 is unstable, and/or is trending towards becoming unstable.

Accordingly, by measuring the stoichiometry at one or more of the nozzles 42, 44, 46, the controller 22 can detect that the flame stability of the combustion chamber is and/or is trending towards becoming unstable, and then correct/maintain the flame stability of the combustion chamber 12 by adjusting the individual stoichiometries of one or more of the nozzles 42, 44, and/or 46. As will be understood, the controller 22 may adjust the stoichiometry of the nozzles 42, 44, and/or 46 by adjusting the amount of primary air 48 and/or fuel 18 fed/delivered to the nozzles 42, 44, and/or 46. Thus, in embodiments, the sensors 82 allow the controller 22 to maintain and/or increase the flame stability of the combustion chamber 12 by monitoring and adjusting the primary air 48 and/or the fuel 18 of one or more of the nozzles 42, 44, and/or 46 in real-time. The controller 22 may also adjust the secondary air 56 and/or the overfired air 58 to adjust the stoichiometry at one or more of the nozzles 42, 44, and/or 46.

As will be appreciated, in embodiments, the sensors 82 may be spectral analyzers that measure the stoichiometry at a particular nozzle 42, 44, and/or 46 by analyzing the frequencies of the photons emitted by the combustion of the primary air 48 and the fuel 18 introduced into the combustion chamber 12 by the nozzle 42, 44, and/or 46. In such embodiments, the sensors 82 may also serve as flame detectors, i.e., devices that ensure that the fuel 18 and primary air 48 at a particular nozzle 42, 44 and/or 46 are in fact combusting. In other embodiments, the sensors 82 may be carbon monoxide ("CO") sensors/detectors 84 (FIG. 1) located downstream of the combustion chamber 12 that are capable of determining the stoichiometry of one or more of the nozzles 42, 44, and/or 46 by analyzing the amount of CO within the generated flue gas.

As will be appreciated, the controller 22 may monitor/measure and/or adjust the stoichiometry of the nozzles 42, 44, and/or 46 via the sensors 82 during normal and/or reduced load operations so as to maintain the flame stability of the combustion chamber 12, i.e., the controller 22 adjusts the stoichiometry of the nozzles 42, 44, and/or 46 so as to mitigate the risk that the flame stability of the combustion chamber will drop to an undesirable level. Accordingly, in embodiments the controller 22 may detect/determine that the flame stability of the combustion chamber 12 is decreasing by sensing fluctuations in the stoichiometry at one or more of the nozzles 42, 44, and/or 46. For example, in embodiments where the sensors 82 are spectral analyzers, fluctuations in the stoichiometry at a nozzle 42, 44, and/or 46 may correspond to variations within spectral lines as measured by the sensors 82 monitoring the stoichiometry at the nozzle 42, 44, and/or 46.

In certain aspects, the controller 22 may adjust the stoichiometries at each of the nozzles 42, 44, and/or 46 such that the stoichiometries at each of the nozzles 42, 44, and/or 46 are substantially uniform with respect to each other. In other words, the controller 22 may ensure that the amount of primary air 48 and fuel 18 delivered to each of the nozzles 42, 44, and/or 46 is substantially the same. For example, if the controller 22 detects via the sensors 82 that the stoichiometry at a first nozzle 42 is higher than the stoichiometry at a second nozzle 44, the controller 22 may either increase the amount of primary air 48 and/or fuel 18 to the second nozzle 44 or decrease the amount of primary air 48 and/or fuel 18 to the first nozzle 42 so that the stoichiometries of the first 42 and the second 44 nozzles are the same/uniform. In embodiments, the controller 22 may adjust the stoichiometries of all of the nozzles, e.g., 46, of a particular firing layer, e.g., 68, so that all of the nozzles on the firing layer are the same/uniform with respect to each other.

Figure 4:
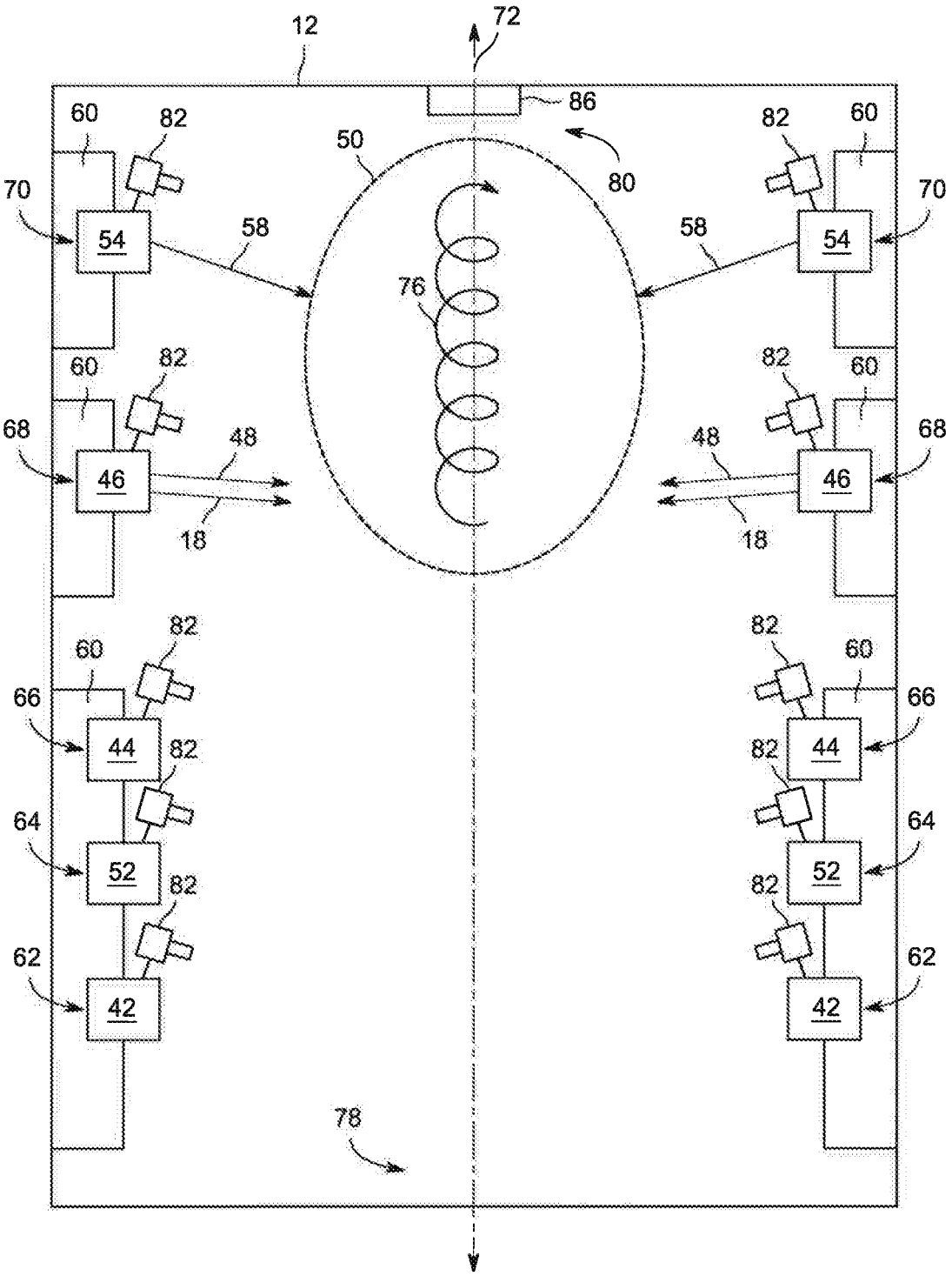
FIG. 4 is another diagram of the combustion chamber of FIG. 2, wherein a fireball has been contained to a downstream side of the combustion chamber, in accordance with an embodiment of the invention.

Turning now to FIG. 4, in embodiments, the controller 22 may be further operative to adjust a first amount of the fuel 18 introduced into the combustion chamber 12 via nozzles, e.g., 42 and/or 44, disposed within a first/lower firing layer, e.g., 62 and/or 66, such that the first amount of the fuel 18 is less than a second amount of the fuel 18 introduced into the combustion chamber 12 via the nozzles, e.g., 46, disposed within a second/higher firing layer, e.g., 68. In other words, the controller 22 may reduce the flow of primary air 48 and/or fuel 18 to the lower nozzles and/or increase the flow of primary air 48 and/or fuel 18 to the higher nozzles so that the fireball 50 is contained to the downstream end/upper region 80 of the combustion chamber 12. As will be appreciated, in embodiments, the lower nozzles, e.g., 42, 52, and/or 44 may be completely shutoff.

Additionally, in embodiments, the system 10 may further include a flame stability sensor 86 which detects/monitors the stability of the fireball 50. For example, in embodiments, the flame stability detector 86 may be a camera mounted to the combustion chamber 12 that looks down the vertical axis 72 at the fireball 50. In such embodiments, dark streaks within the fireball 50, as seen by the flame stability detector 86, may signal that the flame stability of the combustion chamber 12 is degrading. The flame stability sensor 86 may also be a spectral analyzer mounted to the combustion chamber 12 that looks down the vertical axis 72 at the fireball 50 and determines the flame stability based at least in part on analyzing the frequencies of photons emitted by the fireball 50. Thus, in embodiments, the flame stability detector 86 may provide for the detection of extreme low load conditions, i.e., conditions in which the fireball 50 is too unreliable for continued operation of the combustion chamber 12. In other words, the flame stability detector 86 may assist the controller 22 in determining the lowest possible load of the combustion chamber 12.

Returning back to FIG. 1, in embodiments, the system 10 may further include an umbrella/telescoping selective non-catalytic reducer ("SNCR") 88 in electronic communication with the controller 22 and operative to reduce NOx emissions from the combustion chamber 12. As will be appreciated, the umbrella SNCR 88 includes an adjustable telescoping nozzle 90 that allows ammonia, and/or an ammonia forming reagent, to be injected into the combustion chamber 12 at a changing location that has an optimal temperature for NOx reduction, e.g., 1600° F. While reduced load operations usually result in lower flue gas temperatures, e.g., less than 700° F., which in turn may lower the efficiency of the SCR 30 to reduce NOx emissions, reduced load operations usually produce less NOx than normal load operations. Thus, as will be appreciated, in embodiments, the increase in NOx reduction provided by the umbrella SNCR 88 is able to compensate for the decrease in NOx reduction by the SCR 30 resulting from the lower flue gas temperatures associated with reduced load operations.

Figure 5:
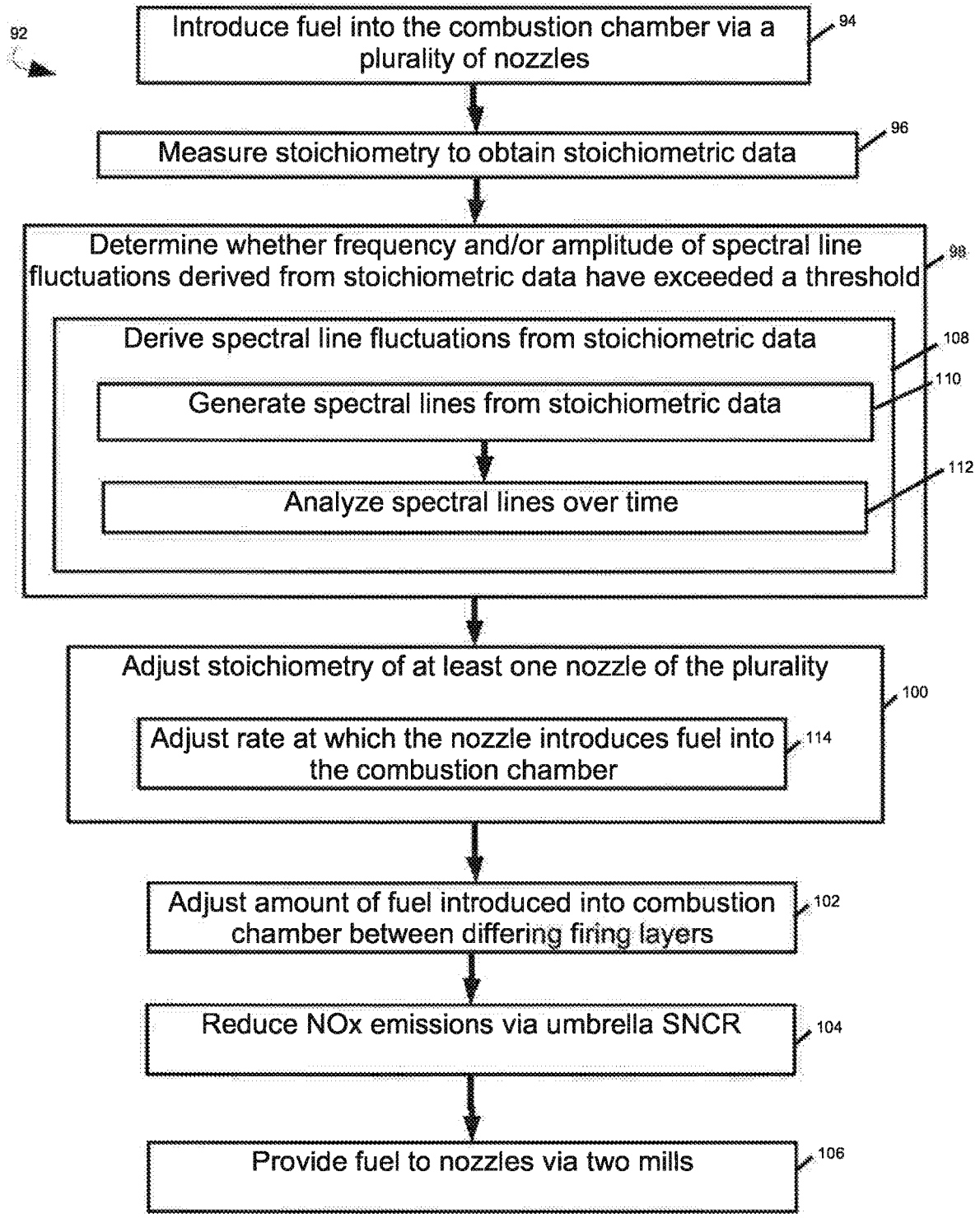
FIG. 5 depicts a flow chart of a method for operating a combustion chamber utilizing the system of FIG. 1, in accordance with an embodiment of the invention.

Moving now to FIG. 5, a method 92 of operating the combustion chamber 10, in accordance with embodiments of the invention, is shown. The method 92 includes introducing 94 the fuel 18 into the combustion chamber 10 via the nozzles 42, 44, and/or 46, and measuring 96 the stoichiometries of each nozzle 42, 44, and/or 46 in a manner as discussed above, to obtain/generate stoichiometric data. As will be understood, in embodiments, measuring 96 the stoichiometries of each nozzle 42, 44, and/or 46 to obtain/generate stoichiometric data includes both measuring the stoichiometries of each nozzle 42, 44, and/or 46 and determining/generating the stoichiometric data from measurements of the stoichiometries of each nozzle 42, 44, and/or 46.

The method 92 further includes determining 98 that the frequency and/or amplitude of the spectral line fluctuations derived from the stoichiometric data has exceeded a threshold, and adjusting 100 the stoichiometry of at least one of the nozzles 42, 44, and/or 46 based at least in part on the stoichiometric data so as to maintain and/or improve the flame stability of the combustion chamber 10. In embodiments, the method 92 may further include adjusting 102 the amount of the fuel 18 introduced into the combustion chamber 10 by the nozzles 42 of a first firing layer 62 to be less than the amount of the fuel 18 introduced into the combustion chamber 10 by the nozzles 46 of a second firing layer 68, i.e., adjusting 102 the amounts of fuel 18 introduced into the combustion chamber 10 between differing firing layers 62, 64, 66, 68, and/or 70. In embodiments, the method 92 may further include reducing 104 NOx emission from the combustion chamber 10 via the umbrella SNCR 88, and/or providing 106 the fuel 18 to the nozzles 42, 44, and/or 46 via two mills 28.

As further shown in FIG. 5, determining 98 that the frequency and/or amplitude of the spectral line fluctuations has exceeded a threshold may include deriving 108 the spectral line fluctuations from the stoichiometric data, which in turn may include generating 110 the spectral lines from the stoichiometric data and analyzing 112 the spectral lines over time. In certain aspects of the invention, adjusting 100 the stoichiometry of at least one of the nozzles 42, 44, and/or 46 based at least in part on the stoichiometric data so as to maintain and/or improve the flame stability of the combustion chamber 10 may include adjusting 114 the amount/rate which the nozzle 42, 44, and/or 46 introduces the fuel 18 into the combustion chamber 10.

Finally, it is to be understood that the system 10 may include the necessary electronics, software, memory, storage, databases, firmware, logic/state machines, microprocessors, communication links, displays or other visual or audio user interfaces, printing devices, and any other input/output interfaces to perform the functions described herein and/or to achieve the results described herein, which may be executed in real-time. For example, as stated above, the system 10 may include at least one processor 24 and system memory/data storage structures 26 in the form of a controller 22 that electrically communicates with one or more of the components of the system 10. The memory may include random access memory ("RAM") and read-only memory ("ROM"). The at least one processor may include one or more conventional microprocessors and one or more supplementary co-processors such as math co-processors or the like. The data storage structures discussed herein may include an appropriate combination of magnetic, optical and/or semiconductor memory, and may include, for example, RAM, ROM, flash drive, an optical disc such as a compact disc and/or a hard disk or drive.

Additionally, a software application that provides for control over one or more of the various components of the system 10 may be read into a main memory of the at least one processor from a computer-readable medium. The term "computer-readable medium," as used herein, refers to any medium that provides or participates in providing instructions to the at least one processor 24 (or any other processor of a device described herein) for execution. Such a medium may take many forms, including but not limited to, non-volatile media and volatile media. Non-volatile media include, for example, optical, magnetic, or opto-magnetic disks, such as memory. Volatile media include dynamic random access memory ("DRAM"), which typically constitutes the main memory. Common forms of computer-readable media include, for example, a floppy disk, a flexible disk, hard disk, magnetic tape, any other magnetic medium, a CD-ROM, DVD, any other optical medium, a RAM, a PROM, an EPROM or EEPROM (electronically erasable programmable read-only memory), a FLASH-EEPROM, any other memory chip or cartridge, or any other medium from which a computer can read.

While in embodiments, the execution of sequences of instructions in the software application causes the at least one processor to perform the methods/processes described herein, hard-wired circuitry may be used in place of, or in combination with, software instructions for implementation of the methods/processes of the present invention. Therefore, embodiments of the present invention are not limited to any specific combination of hardware and/or software.

It is further to be understood that the above description is intended to be illustrative, and not restrictive. For example, the above-described embodiments (and/or aspects thereof) may be used in combination with each other. Additionally, many modifications may be made to adapt a particular situation or material to the teachings of the invention without departing from its scope.

For example, in an embodiment, a method for operating a combustion chamber is provided. The method includes introducing a fuel into the combustion chamber via a plurality of nozzles, each nozzle having an associated stoichiometry for an output end of the nozzle. The method further includes measuring the stoichiometry of each nozzle via one or more sensors to obtain stoichiometric data, and determining that at least one of a frequency and an amplitude of spectral line fluctuations derived from the stoichiometric data has exceeded a threshold. The method further includes adjusting the stoichiometry of at least one of the nozzles based at least in part on the stoichiometric data so as to maintain a flame stability of the combustion chamber. In certain embodiments, introducing a fuel into the combustion chamber via a plurality of nozzles is in accordance with a reduced load for the combustion chamber. In certain embodiments, the reduced load is less than or equal to 20% of the maximum operating load. In certain embodiments, the frequency and the amplitude of the spectral line fluctuations are associated with the flame stability of the combustion chamber. In certain embodiments, the stoichiometry of the at least one nozzle is adjusted such that the stoichiometries of all of the nozzles are substantially uniform with respect to each other. In certain embodiments, at least one of the one or more sensors is a spectral analyzer. In certain embodiments, at least one of the one or more sensors is a carbon monoxide sensor. In certain embodiments, the method further includes adjusting a first amount of the fuel introduced into the combustion chamber via nozzles of the plurality disposed within a first firing layer such that the first amount of the fuel is less than a second amount of the fuel introduced into the combustion chamber via nozzles of the plurality disposed within a second firing layer. In certain embodiments, the method further includes reducing NOx emissions from the combustion chamber via an umbrella selective non-catalytic reducer. In certain embodiments, the method further includes providing the fuel to the nozzles via two mills. In certain embodiments, adjusting the stoichiometry of at least one of the nozzles includes adjusting a rate at which the at least one nozzle introduces the fuel into the combustion chamber.

Other embodiments provide for a system for operating a combustion chamber. The system includes a plurality of nozzles operative to introduce a fuel into the combustion chamber, one or more sensors operative to obtain stoichiometric data via measuring a stoichiometry associated with an output end of at least one of the nozzles, and a controller in electronic communication with the nozzles and the one or more sensors. The controller is operative to determine that at least one of a frequency and an amplitude of spectral line fluctuations derived from the stoichiometric data has exceeded a threshold, and to adjust the stoichiometry of at least one of the nozzles based at least in part on the stoichiometric data so as to maintain a flame stability of the combustion chamber. In certain embodiments, the fuel is introduced into the combustion chamber via the plurality of nozzles in accordance with a reduced load for the combustion chamber. In certain embodiments, the reduced load is less than or equal to 20% of the maximum operating load. In certain embodiments, the frequency and the amplitude of the spectral line fluctuations are associated with the flame stability of the combustion chamber. In certain embodiments, the controller adjusts the stoichiometry of the at least one nozzle such that the stoichiometries of all of the nozzles are substantially uniform with respect to each other. In certain embodiments, at least one of the one or more sensors is a spectral analyzer. In certain embodiments, the controller is further operative to adjust a first amount of the fuel introduced into the combustion chamber via nozzles of the plurality disposed within a first firing layer such that the first amount of the fuel is less than a second amount of the fuel introduced into the combustion chamber via the nozzles of the plurality disposed within a second firing layer. In certain embodiments, the system further includes an umbrella selective non-catalytic reducer in electronic communication with the controller and operative to reduce NOx emissions from the combustion chamber.

Yet still other embodiments a non-transitory computer readable medium storing instructions. The stored instructions are configured to adapt a controller to introduce a fuel into a combustion chamber via a plurality of nozzles, and to measure a stoichiometry associated with an output end of at least one of the nozzles via one or more sensors to obtain stoichiometric data. The stored instructions are further configured to adapt the controller to determine that at least one of a frequency and an amplitude of spectral line fluctuations derived from the stoichiometric data has exceeded a threshold, and to adjust the stoichiometry of at least one of the nozzles based at least in part on the obtained stoichiometric data so as to maintain a flame stability of the combustion chamber.

Accordingly, by adjusting the stoichoimetries of one or more nozzles during reduced load operations, some embodiments of the invention may provide for a combustion chamber that operates at a reduced load that is less than or equal to twenty percent (20%) of its maximum operating load while mitigating the risks associated with low flame stabilities. Thus, some embodiments provide for significant reductions in the amount of fuel consumed by fossil fuel based power plants connected to power grids having renewable energy sources.

Additionally, the controller in some embodiments may reduce the primary air and/or the fuel to the nozzles during reduced load operations such that two mills are sufficient to feed the fuel to the nozzles. In such embodiments, the mills may operate at less than half of their normal feeder speeds, and additional instrumentation, e.g., vibration monitors disposed on the mills, and the flame stability monitors in the combustion chamber, to ensure safe operation of the mills, i.e., that the fuel at each nozzle is combusting and/or that the vibration within the mills is within normal operating ranges. As will be appreciated, the ability of such embodiments to operate on two mills may provide for significant improvements in efficiency, e.g., lower operation costs, over traditional fossil fuel based power plants.

Moreover, by detecting fluctuations within the stoichiometry at nozzles, as compared to monitoring the stoichiometry simply to make sure that emission standards are met, some embodiments of the invention provide for the ability to maintain and/or improve the flame stability of a combustion chamber at normal and/or reduced load operations.

While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted as such, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described invention, without departing from the spirit and scope of the invention herein involved, it is intended that all of the subject matter of the above description shown in the accompanying drawings shall be interpreted merely as examples illustrating the inventive concept herein and shall not be construed as limiting the invention.

What is claimed is:

1. A system for operating a combustion chamber comprising:

a plurality of nozzles configured to introduce a fuel into the combustion chamber;

one or more sensors configured to obtain stoichiometric data via measuring a stoichiometry associated with an output end of at least one of the nozzles, wherein the one or more sensors are spectral analyzers that measure the stoichiometry directly at the at least one of the nozzles by analyzing the frequencies of the photons emitted by the combustion of primary air and the fuel introduced into the combustion chamber by the at least one of the nozzles; and a controller in electronic communication with the nozzles and the one or more sensors;

wherein the controller is configured to:

determine that at least one of a frequency and an amplitude of spectral line fluctuations derived from the stoichiometric data has exceeded a threshold; and adjust the stoichiometry associated with an output end of at least one of the nozzles based at least in part on the stoichiometric data so as to maintain a flame stability of the combustion chamber;

wherein the threshold is a change in frequency and/or amplitude of the spectral line fluctuations of between about 20% to about 25% from a baseline frequency and/or amplitude.

2. The system of claim 1, wherein the fuel is introduced into the combustion chamber via the plurality of nozzles in accordance with a reduced load for the combustion chamber.

3. The system of claim 2, wherein the reduced load is less than or equal to 20% of the maximum operating load.

4. The system of claim 1, wherein the frequency and the amplitude of the spectral line fluctuations are associated with the flame stability of the combustion chamber.

5. The system of claim 1, wherein the controller is configured to adjust the stoichiometry associated with an output end of each of the nozzles such that the stoichiometries of each of the nozzles, including the air to fuel ratio of each of the nozzles, is substantially uniform with respect to each other.

6. The system of claim 1, wherein the controller is further configured to adjust a first amount of the fuel introduced into the combustion chamber via a first array of nozzles of the plurality of nozzles disposed within a first firing layer such that the first amount of the fuel is less than a second amount of the fuel introduced into the combustion chamber via a second array of nozzles of the plurality of nozzles disposed within a second firing layer, the second firing layer being positioned at a location spaced vertically and downstream from the first firing layer.

7. The system of claim 1 further comprising:

an umbrella selective non-catalytic reducer in electronic communication with the controller and configured to reduce NOx emissions from the combustion chamber.

8. The system of claim 1, wherein:

the plurality of nozzles include:

a first subset of nozzles arranged in a first firing layer, the first subset of nozzles in the first firing layer being configured to introduce a fuel into the combustion chamber;

a second subset of nozzles arranged in a second firing layer, the second subset of nozzles in the second firing layer being configured to introduce a fuel into the combustion chamber, the second firing layer being located vertically above the first firing layer; and a third subset of nozzles arranged in a third firing layer, the third subset of nozzles being configured to introduce at least one of secondary air and/or overfire air into the combustion chamber, the third firing layer being located vertically above at least one of the first firing layer and the second firing layer; and wherein the one or more sensors include a sensor associated with each of the nozzles of the first subset of nozzles, the second subset of nozzles and the third subset of nozzles.

9. The system of claim 1, further comprising:

a flame stability sensor mounted adjacent to a top of the combustion chamber along a vertical axis of the combustion chamber and being configured to look down the vertical axis to monitor a flame stability of a fireball within the combustion chamber and below the flame stability sensor;

wherein the vertical axis of the combustion chamber is a central axis of the combustion chamber.

10. The system of claim 1, further comprising:

a carbon monoxide sensor located downstream of the combustion chamber and being configured to analyze an amount of carbon monoxide within a flue gas exiting the combustion chamber.

11. A system for operating a combustion chamber comprising:

a plurality of nozzles configured to introduce a fuel into the combustion chamber;

one or more sensors configured to obtain stoichiometric data via measuring a stoichiometry associated with an output end of at least one of the nozzles, wherein the one or more sensors are spectral analyzers that measure the stoichiometry at the at least one of the nozzles by analyzing the frequencies of the photons emitted by the combustion of primary air and the fuel introduced into the combustion chamber by the at least one of the nozzles;

a flame stability sensor mounted adjacent to a top of the combustion chamber along a central axis of the combustion chamber and being configured to look down the central axis to monitor a flame stability of a fireball within the combustion chamber and below the flame stability sensor; and a controller in electronic communication with the nozzles and the one or more sensors;

wherein the controller is configured to:

determine that at least one of a frequency and an amplitude of spectral line fluctuations derived from the stoichiometric data has exceeded a threshold; and adjust the stoichiometry associated with an output end of at least one of the nozzles based at least in part on the stoichiometric data so as to maintain a flame stability of the combustion chamber;

wherein the threshold is a change in frequency and/or amplitude of the spectral line fluctuations of between about 20% to about 25% from a baseline frequency and/or amplitude.

* * * * *